US007632171B2

(12) United States Patent
Heesemann

(10) Patent No.: US 7,632,171 B2
(45) Date of Patent: Dec. 15, 2009

(54) GRINDING MACHINE

(76) Inventor: Juergen Heesemann, Gruener Weg 52, 32547 Bad Oeynhausen (DE)

( * ) Notice: Subject to any disclaimer, the term of this patent is extended or adjusted under 35 U.S.C. 154(b) by 0 days.

(21) Appl. No.: 12/165,927

(22) Filed: Jul. 1, 2008

(65) Prior Publication Data

US 2009/0011689 A1 Jan. 8, 2009

(30) Foreign Application Priority Data

Jul. 6, 2007 (DE) ..... 10 2007 031 656

(51) Int. Cl.
*B24B 7/07* (2006.01)

(52) U.S. Cl. ..... 451/66; 451/57; 451/190; 451/260

(58) Field of Classification Search ..... 451/57, 451/65, 66, 178, 182, 190, 194, 195, 260, 451/261, 262, 271
See application file for complete search history.

(56) References Cited

U.S. PATENT DOCUMENTS 1,666,347 A * 4/1928 Platt ..... 451/160
1,732,695 A * 10/1929 Platt ..... 451/160
2,948,087 A 8/1960 Caton
2,985,989 A * 5/1961 Knost ..... 451/41
6,113,472 A * 9/2000 Rosa ..... 451/49
2002/0068515 A1 * 6/2002 Butfering et al. ..... 451/119
2007/0099546 A1 * 5/2007 Jespersen ..... 451/11

FOREIGN PATENT DOCUMENTS

EP 1 541 285 A1 11/2004
WO WO 2005/056234 A1 6/2005

* cited by examiner

*Primary Examiner*—Timothy V Eley
(74) *Attorney, Agent, or Firm*—Whitham Curtis Christofferson & Cook, PC

(57) ABSTRACT

In a grinding machine with a grinding means for machining a workpiece surface which can be moved in a direction of conveyance relative to the grinding means and is arranged in a machining plane, wherein the grinding means has a large number of grinding heads with grinding elements (8) rotating about a respective shaft, and the grinding heads can be moved by means of an endlessly revolving transporting means (1) in a grinding region (3) by deflection about deflection rollers via rectilinear portions in a grinding region at an angle to the direction of conveyance, improved grinding results are facilitated as a result of increased degrees of freedom in the setting of the grinding parameters without high costs for drive motors if a drive means (13), with which the grinding elements (8) are driven in rotation by a common motor provided for rotationally driving these grinding elements (8), is provided for at least one group of a plurality of grinding elements (8), and in that the drive means (13) consists of a flexible frictional engagement or positive engagement assembly which is guided parallel to the transporting means (1) about deflection rollers (22) and is formed with the shafts (17) of the grinding elements (8) for rotationally driving irrespective of the speed of transportation of the grinding elements (8).

10 Claims, 5 Drawing Sheets

GRINDING MACHINE

BACKGROUND OF THE INVENTION

1. Field of the Invention

The invention relates to a grinding machine with a grinding means for machining a workpiece surface which can be moved in a direction of conveyance relative to the grinding means and is arranged in a machining plane, wherein the grinding means has a large number of grinding heads with grinding elements rotating about a respective shaft, and the grinding heads can be moved by means of an endlessly revolving transporting means in a grinding region by deflection about deflection rollers via rectilinear portions in a grinding region at an angle to the direction of conveyance.

2. Background of the Invention

Grinding machines of this type are known. EP 1 541 285 A1 discloses grinding tools which are attached to a respective carriage and are drawn by a revolving chain along a guide rail. The grinding tools consist for example of plate grinders, which are rotationally driven as a result of the fact that the guide rail is toothed in its configuration and a gear-wheel is made to rotate on a vertical shaft of the plate grinder as a result of the movement of the grinding tool in interaction with the guide rail. The rotational speed of the plate grinder is thus dependent on the speed at which the plate grinder is drawn by the chain. In an alternative embodiment, each plate grinder has its own motor drive. In this case, the grinding tools can also be configured as roll grinders, the orientation of which in relation to the direction of conveyance of the workpiece may differ.

WO 2005/056234 A1 discloses a grinding machine comprising a plurality of grinding heads which are fastened to a revolving chain. The grinding heads are plate grinders which machine the workpiece surface with an end-face surface. The grinding machine requires a drive motor for the transport chain and drive motors for each grinding element. The possibility of driving the grinding elements at a rotational speed which is independent of the speed of transportation of the grinding heads thus requires high drive motor costs.

SUMMARY OF THE INVENTION

The invention is therefore based on the object of allowing improved grinding results as a result of increased degrees of freedom in the setting of the grinding parameters without high costs for drive motors.

According to the invention, in the case of a grinding machine of the type mentioned at the outset, this object is achieved as a result of the fact that a drive means, with which the grinding elements are driven in rotation by a common motor provided for rotationally driving these grinding elements, is provided for at least one group of a plurality of grinding elements, and that the drive means consists of a flexible frictional engagement or positive engagement assembly which is guided parallel to the transporting means about deflection rollers and is formed with the shafts of the grinding elements for rotationally driving irrespective of the speed of transportation of the grinding elements.

The grinding machine according to the invention thus provides, in addition to the endlessly revolving transporting means for the revolving transportation of the grinding heads, at least one drive means which causes a plurality of grinding elements to rotate, preferably in the same direction of rotation, so only one motor is required for rotationally driving this plurality of grinding elements. The grinding elements of the group are driven by the same motor, so that their rotational speed is determined from the rotational speed of the one motor. Expediently, the rotational speeds of all the grinding elements of the group are equal.

The drive means preferably consists of a revolving flexible frictional engagement or positive engagement assembly, i.e. preferably of a drive chain, a drive toothed belt or a V-belt which interacts with corresponding counterpart means on the shaft of the grinding element. Preferred is the configuration with a revolving toothed belt which is insusceptible to slippage.

The grinding machine according to the invention can be provided with a single group of grinding elements. In this case, just a single drive means is provided with a single motor which drives all of the grinding elements during transportation with the endlessly revolving transporting means.

A preferred embodiment provides two drive means which drive two groups of grinding elements. The groups are in this case configured in such a way that mutually adjacent grinding elements each pertain to a different group. Expediently, the grinding elements of the two groups are driven in opposite directions, as a result of which a more uniform grinding result is achieved. Nevertheless, each of the two groups requires just a single drive motor.

The grinding elements can preferably be formed by brushes, the shafts about which the grinding elements rotate being located preferably perpendicularly to the machining plane.

The grinding means is preferably configured so as to be wider than the maximum width of the workpiece, based on the direction of conveyance. The grinding region, in which the grinding elements are active on the workpiece surface, can be formed in particular by a rectilinear path on which the grinding heads are transported perpendicularly to the direction of conveyance via the surface of the workpiece and in this case machine the workpiece surface as a result of the rotational movement. The fact that the grinding heads are driven in revolution produces downstream in the direction of conveyance a further corresponding path forming a grinding region in which the grinding heads are guided in opposite directions transversely to the direction of conveyance via the workpiece.

Obviously, it is possible to provide angled rectilinear grinding regions or for example to form a grinding region with a triangular transporting path of the grinding heads.

The described grinding means can form a grinding station of a grinding machine comprising a plurality of, i.e. at least two, grinding stations. The further grinding station(s) can be configured with other grinding elements, for example as a belt grinding unit, in order to allow differing grinding machinings of the workpiece surface. The grinding stations are therefore preferably modular in their construction, so that they can be constructed so as to be exchangeable and in differing orders.

The invention will be described hereinafter in greater detail with reference to an exemplary embodiment illustrated in the drawings, in which:

DETAILED DESCRIPTION OF THE PREFERRED EMBODIMENTS OF THE INVENTION

Figure 1:
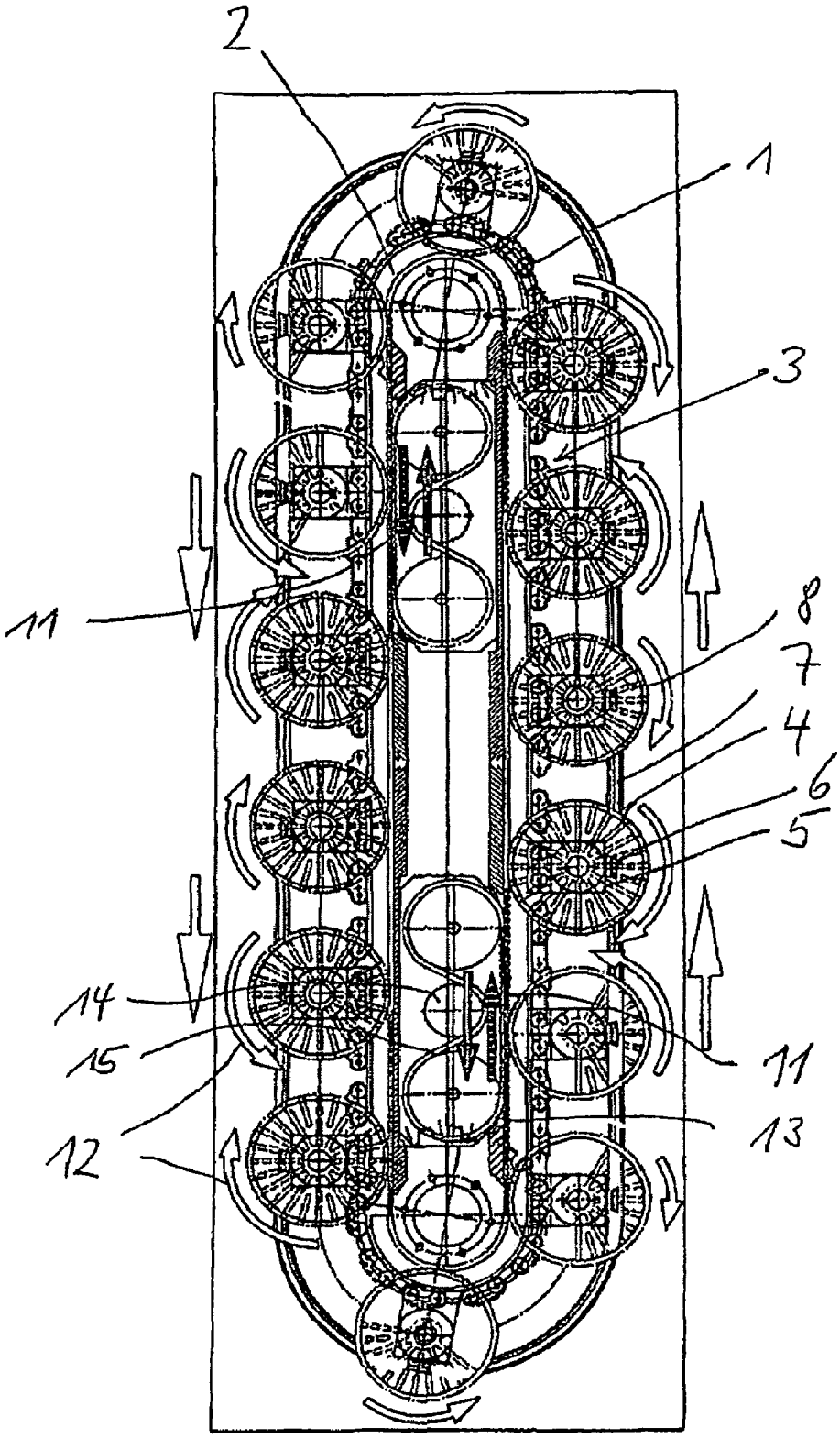
FIG. 1 is a schematic plan view onto a grinding means of a grinding machine according to an embodiment according to the invention.

FIG. 1 shows a grinding means in which a transport chain 1 revolves endlessly as a transporting means and is deflected about two deflection wheels 2 at the end of a rectilinear chain portion 3. This produces two rectilinear chain portions 3 which are oriented perpendicularly to a direction of conveyance of a workpiece which is conveyed through below the grinding means. Grinding units 4 are fastened to the transport chain 1 by means of a housing foot 5 which is fastened to the outside of the chain in relation to the revolving chain 1. The opposing end of the housing foot 5 is provided with a roller 6 which is guided in a support rail 7 revolving parallel to the chain 1.

In the illustrated exemplary embodiment, the grinding unit 4 has grinding elements 8 which are formed by brushes having bristles directed downward (toward the surface of the workpiece) and form in plan view a circular cross section. In a corresponding size, the grinding units 4 are each provided with a driven disk 9 in the form of a gear-wheel, adjacent grinding units having the associated driven disk at various axial heights. Two revolving flexible drive belts, which revolve parallel to the chain 1 in plan view inside the chain 1 at two different heights, with differing running directions, as is indicated in FIG. 1 by the arrows 11, are provided for driving the driven disks 9. Accordingly, adjacent grinding units 4 rotate in differing directions of rotation, as is illustrated in FIG. 1 by the arrows 12.

A drive roller device 13, via which a driving belt 15 is guided with a tension roller 14, is provided for driving the drive belts 10. Preferably, the driving belt is provided with outer teeth with which inner teeth of the drive belt 10 engage, so that the drive belt is driven by the driving belt 15 without slippage.

Figure 2:
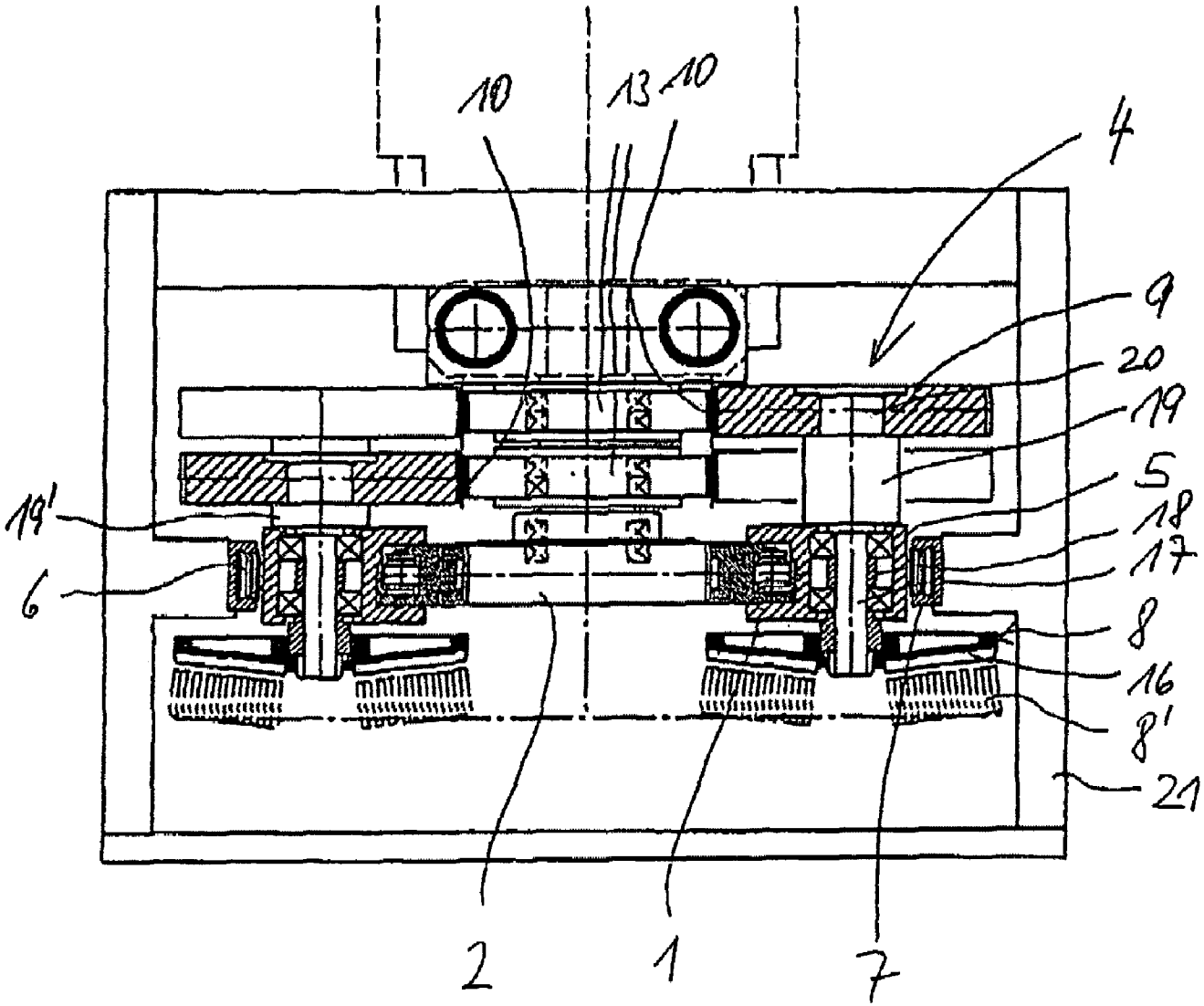
FIG. 2 is a vertical section through the conveying means, in which the sectional plane runs perpendicularly to the direction of conveyance.

FIG. 2 illustrates the construction of the grinding units 4 in a vertical section which is located in the direction of conveyance and is configured through two grinding units 4.

The grinding elements 8 of the grinding units each have a circular plate 16, at the centers of which a shaft 17 is fastened. The plate 16 carries the downwardly protruding bristles 8' with which the grinding element 8 acts on the surface of a workpiece. The shaft 17 extends through the housing foot 5 in that it is rotatably mounted with needle bearings 18. Above the housing foot 5, the shaft is provided with a spacer piece 19, 19', the diameter of which is much larger than the diameter of the shaft 17 within the housing foot 5. The shaft is rotationally engaged with the driven disk 9 in the form of a gear-wheel by an upwardly protruding lug 20. The gear-wheel 9, which is formed with teeth on its circumference, meshes with the associated drive belt 10 which is driven in revolution and two of which revolve at differing heights. The shafts having the longer spacer piece 19 have gear-wheels 9 meshing with the upper drive belt 10, whereas the gear-wheels 9 of the shafts having the shorter spacer piece 19' mesh with the lower revolving drive belt.

FIG. 2 also shows that the revolving support rail 7 is fixedly mounted in a machine frame 21 and that the rollers 6 of the grinding units 4 are guided in the support rail 7 with positive engagement.

FIG. 2 also shows that the apparatus feet 5 of the grinding units 8 are rigidly connected to the links of the chain 1 and that the chain 1 is deflected via a deflection wheel 2. (Non-driven) deflection rollers 22 for the drive belts 10 are shown in FIG. 2 above the deflection wheel 2.

Figure 3:
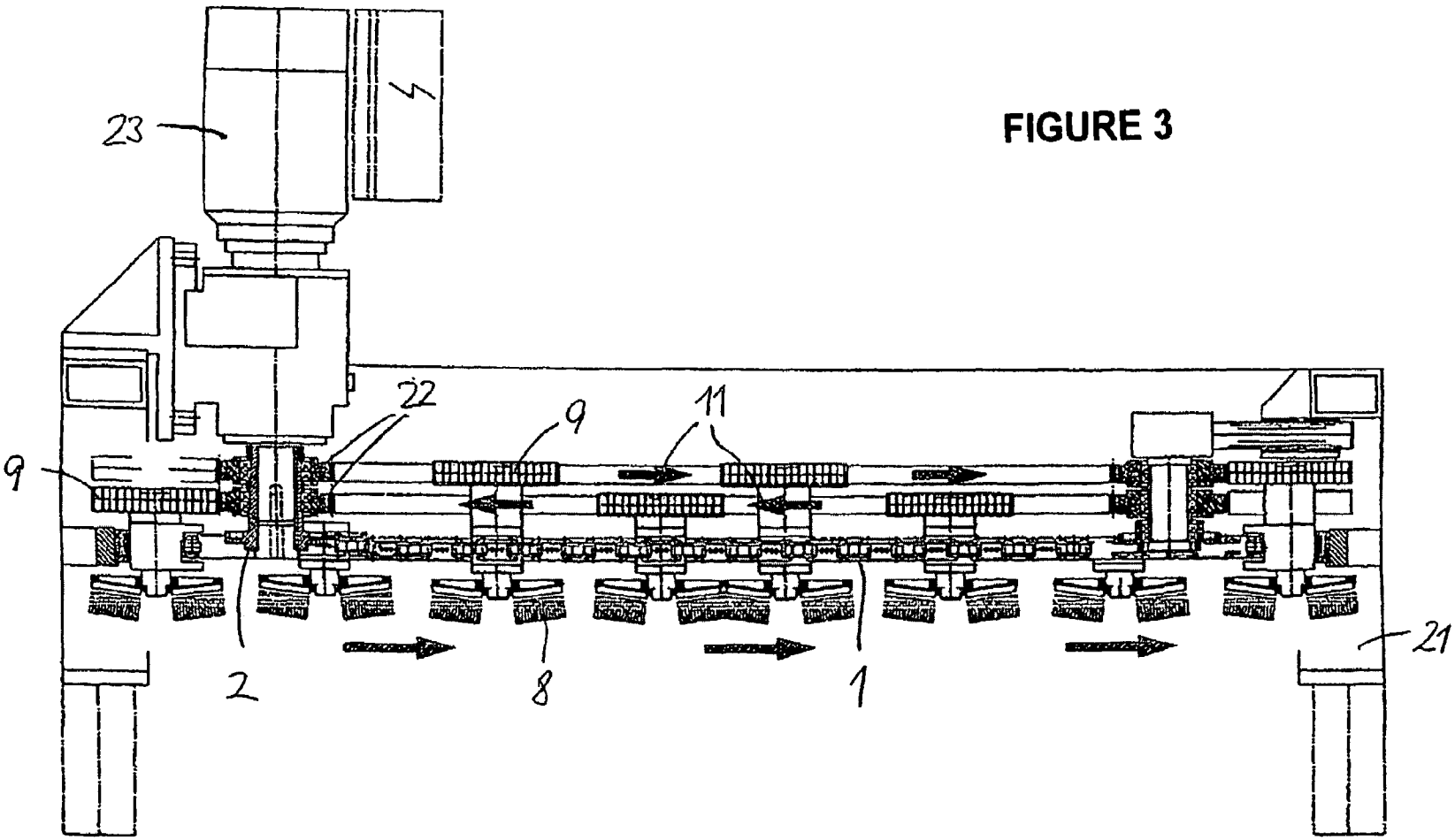
FIG. 3 is a vertical section through the grinding means parallel to the direction of conveyance, so that the sectional plane runs parallel to the direction of conveyance of the workpiece.

FIG. 3 shows that one of the deflection rollers 2 for the transport chain 1 is driven by an electric motor 23. In this case too, (non-driven) deflection rollers 22 for the drive belts 10 are mounted above the driven deflection roller 2.

Figure 4:
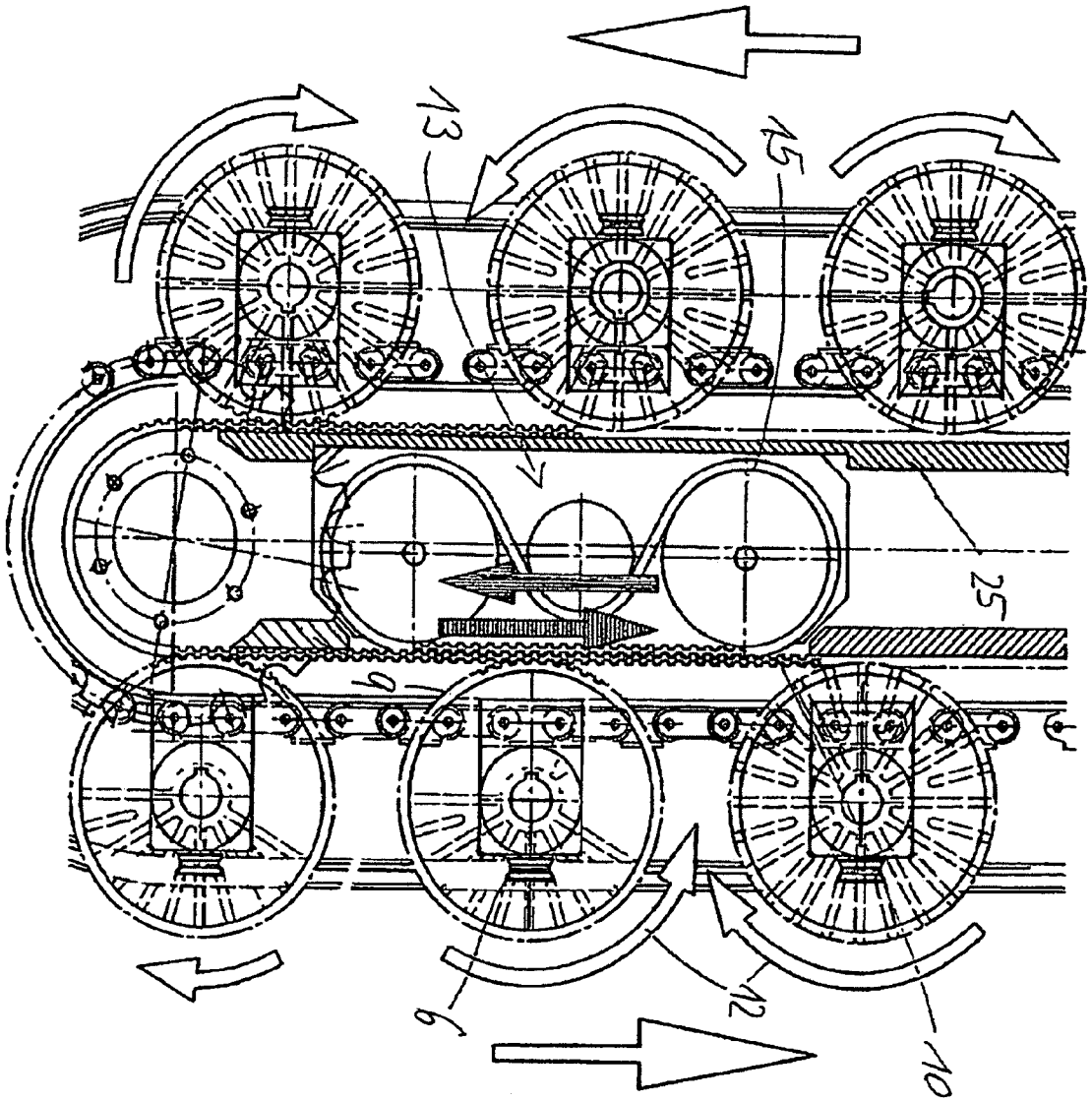
FIG. 4 is an enlarged view of a drive means for rotationally driving the grinding elements.

FIG. 4 is an enlarged view of, in particular, the drive roller assembly 13 via which the driving belt 15 for the drive belt 10 is guided, the drive belt 10 being configured so as to be toothed on both sides.

Figure 5:
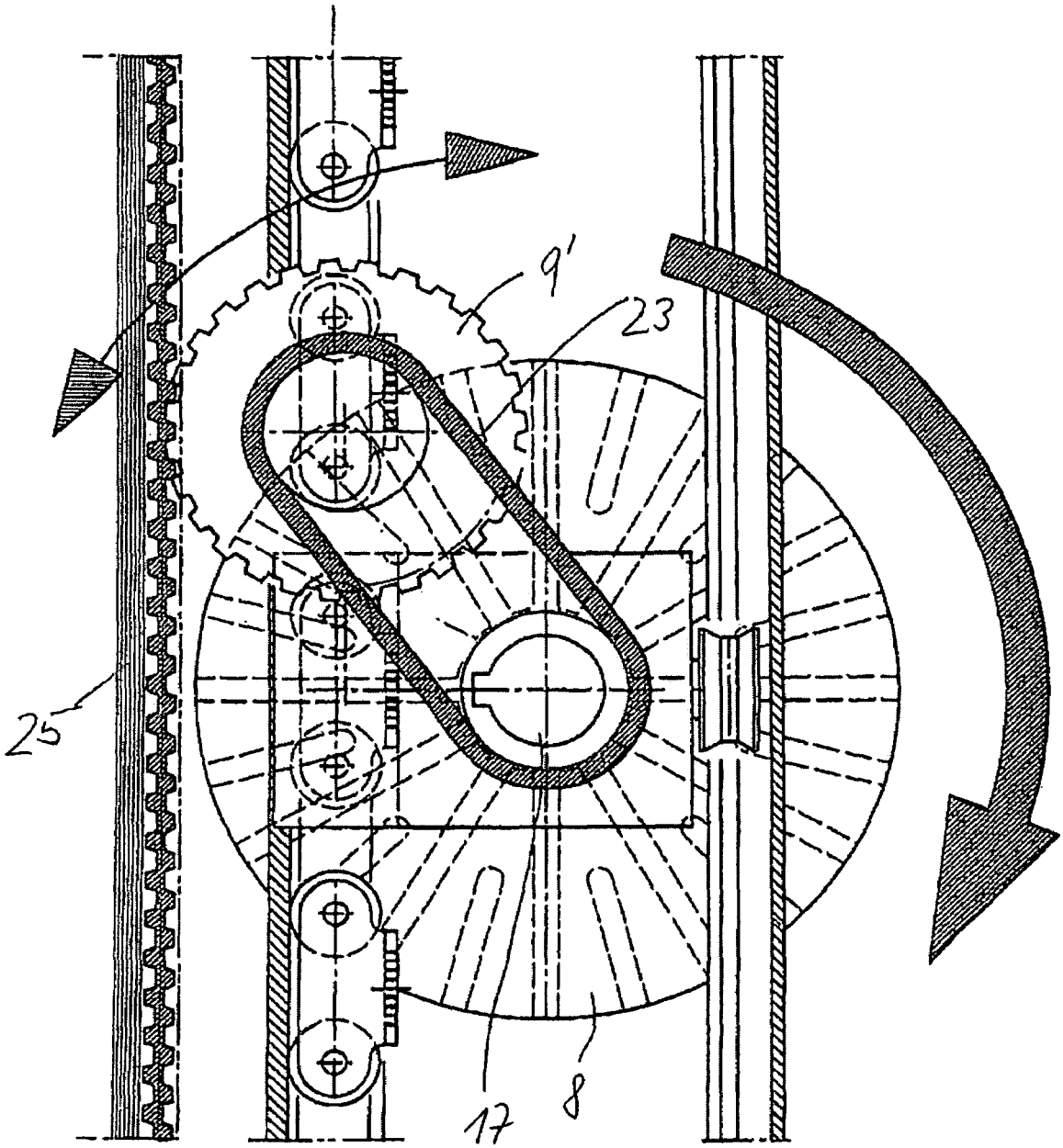
FIG. 5 is an enlarged detailed view of a rotational drive of the grinding elements that has been modified compared to FIG. 1.

FIG. 5 illustrates another embodiment for driving the grinding elements 8. In this embodiment, the driven disk in the form of the gear-wheel 9' does not rest on the shaft 17 but rather is connected to the shaft via a drive belt connection 23. The gear-wheel 9' is mounted on a pivot lever which can pivot in the direction of the double-headed arrow indicated in FIG. 5. Under the load of a spring (not shown), the pivot lever is pressed against the associated drive belt 10 which is configured with double teeth in this case too. The arrangement with the spring-loaded pivot lever has the advantage that secure and slip-free driving of the gear-wheel 9' is ensured even if the drive belt 10 should lengthen somewhat in use and therefore might tend to yield inwardly, i.e. away from the gear-wheel 9, 9'. In order to prevent this, the drive belt 10 is moreover supported by a linear guide 25 along the rectilinear chain portions on which the drive roller assembly 13 is not located. This linear guide 25 is also included in the exemplary embodiment according to FIGS. 1 to 4.

The invention claimed is:

1. A grinding machine with a grinding means for machining a workpiece surface which can be moved in a direction of conveyance relative to the grinding means and is arranged in a machining plane, wherein the grinding means has a large number of grinding heads with grinding elements (8) rotating about a respective shaft, and the grinding heads can be moved by means of an endlessly revolving transporting means (1) in a grinding region (3) by deflection about deflection rollers via rectilinear portions in a grinding region at an angle to the direction of conveyance, wherein a drive means (13), with which the grinding elements (8) are driven in rotation by a common motor provided for rotationally driving these grinding elements (8), is provided for at least one group of a plurality of grinding elements (8), and in that the drive means (13) consists of a flexible frictional engagement or positive engagement assembly which is guided parallel to the transporting means (1) about deflection rollers (22) and is formed with the shafts (17) of the grinding elements (8) for rotationally driving irrespective of the speed of transportation of the grinding elements (8).

2. The grinding machine as claimed in claim 1, wherein the grinding elements (8) which are driven in rotation by the drive means (13) all rotate in the same direction of rotation.

3. The grinding machine as claimed in claim 2, wherein the drive means has a revolving toothed belt (10).

4. The grinding machine as claimed in claim 1, wherein two drive means (13, 10) are provided and each drives in rotation a group of grinding elements (8).

5. The grinding machine as claimed in claim 4, wherein the drive means (13, 10) revolve in opposite directions.

6. The grinding machine as claimed in claim 5, wherein each second grinding element (8) of said plurality of grinding elements (8) pertains to the at least one group driven by one of the drive means (13,10) and the respectively adjacent grinding elements (8) of said plurality of grinding elements (8) are combined to form another group, so that adjacent grinding elements (8) rotate in opposite directions.

7. The grinding machine as claimed in claim 1, wherein the grinding elements (8) have brushes.

8. The grinding machine as claimed in claims 1, wherein the shafts (17) about which the grinding elements (8) rotate are located perpendicularly to the machining plane.

9. The grinding machine as claimed in claim 1, wherein the rotational driving of the grinding elements (8) remains effective throughout the revolving of the transporting means (1).

10. A grinding machine comprising a plurality of grinding stations, of which at least one is configured with a grinding means as claimed in claim 1.

* * * * *